US006032330A

United States Patent [19]

Chen

[11] Patent Number: 6,032,330

[45] Date of Patent: Mar. 7, 2000

[54] LOCATING STRUCTURE OF OIL PRESSURE DOOR CLOSER

[76] Inventor: Sha-Na Chen, No. 4, Alley 71, Lane 177, Sec. 2, Yuan Gi Rd., Yuan Lin Chen, Chang Hwa Hsien, Taiwan

[21] Appl. No.: 09/188,171

[22] Filed: Nov. 9, 1998

[51] Int. Cl.[7] ..... E05F 1/00; E05F 3/00

[52] U.S. Cl. ..... 16/71; 16/49; 16/51

[58] Field of Search ..... 16/71, 49, 51, 16/66, 84, 82, 271, DIG. 43, DIG. 40; 403/201; 248/489, 200; 49/358, 137, 501

[56] References Cited

U.S. PATENT DOCUMENTS 3,188,682 6/1965 Check et al. ..... 16/49
4,086,681 5/1978 Nakanishi ..... 16/71
4,831,687 5/1989 Lin et al. ..... 16/49
4,847,946 7/1989 Nam et al. ..... 16/53

*Primary Examiner*—Chuck Y. Mah
*Attorney, Agent, or Firm*—Browdy and Neimark

[57] ABSTRACT

A locating structure of an oil pressure door closer is composed of a locating plate, a main body of the door closer, and a plurality of fastening pins. The locating plate is fastened with a door and provided with a plurality of fastening holes. The main body is provided in one longitudinal side thereof with two longitudinal edges parallel to each other and forming therebetween a longitudinal space for accommodating the locating plate. The two longitudinal edges are provided with a plurality of through holes corresponding in location to the fastening holes of the locating plate. The fastening pins are received in the through holes and the fastening holes for fastening the main body with the locating plate.

4 Claims, 3 Drawing Sheets

LOCATING STRUCTURE OF OIL PRESSURE DOOR CLOSER

FIELD OF THE INVENTION

The present invention relates generally to an oil pressure door closer, and more particularly to a locating structure of the oil pressure door closer.

BACKGROUND OF THE INVENTION

The conventional oil pressure door closer is generally composed of a main body fastened with the top rail of a door, and a crank arm fastened at one end thereof with the main body and at other end thereof with a door frame. The main body has two protruded blocks which are made integrally at both ends of the main body and are provided with a fastening hole for fastening the main body with the top rail of the door in conjunction with a screw which is engaged with the fastening hole. The protruded blocks undermine the esthetic effect of the door. There is an improved oil pressure door closer which is provide with the protruded blocks that are concealed by the main body of the door closer. This improved door closer is defective in design in that the main body and the locating structure of the door closer are fastened together by a bolt, thereby making the fastening bolt rather vulnerable to a tangential force brought about by the main body and the locating structure at the time when the door is opened. As a result of the bolt being exerted on by the tangential force for a prolonged period of time, the bolt is prone to become loosened to result in the detachment of the main body of the door closer with the door.

SUMMARY OF THE INVENTION

It is therefore the primary objective of the present invention to provide an improved door closer with a main body and a locating structure which is securely fastened with the main body.

It is another objective of the present invention to provide a door closer with a locating structure capable of being mounted with ease and speed.

In keeping with the principle of the present invention, the foregoing objectives of the present invention are attained by a door closer consisting of a locating plate, a main body and a plurality of fastening pins. The locating plate is fastened with the upper end of a door and provided with a plurality of fastening holes parallel to the surface of the door. The main body is provided with a space defined by two longitudinal edges of the same longitudinal side of the main body. The locating plate is securely located in the space of the main body by the fastening pins which are received in the fastening holes of the locating plate and a plurality of through holes of the main body.

DETAILED DESCRIPTION OF THE INVENTION

Figure 1:
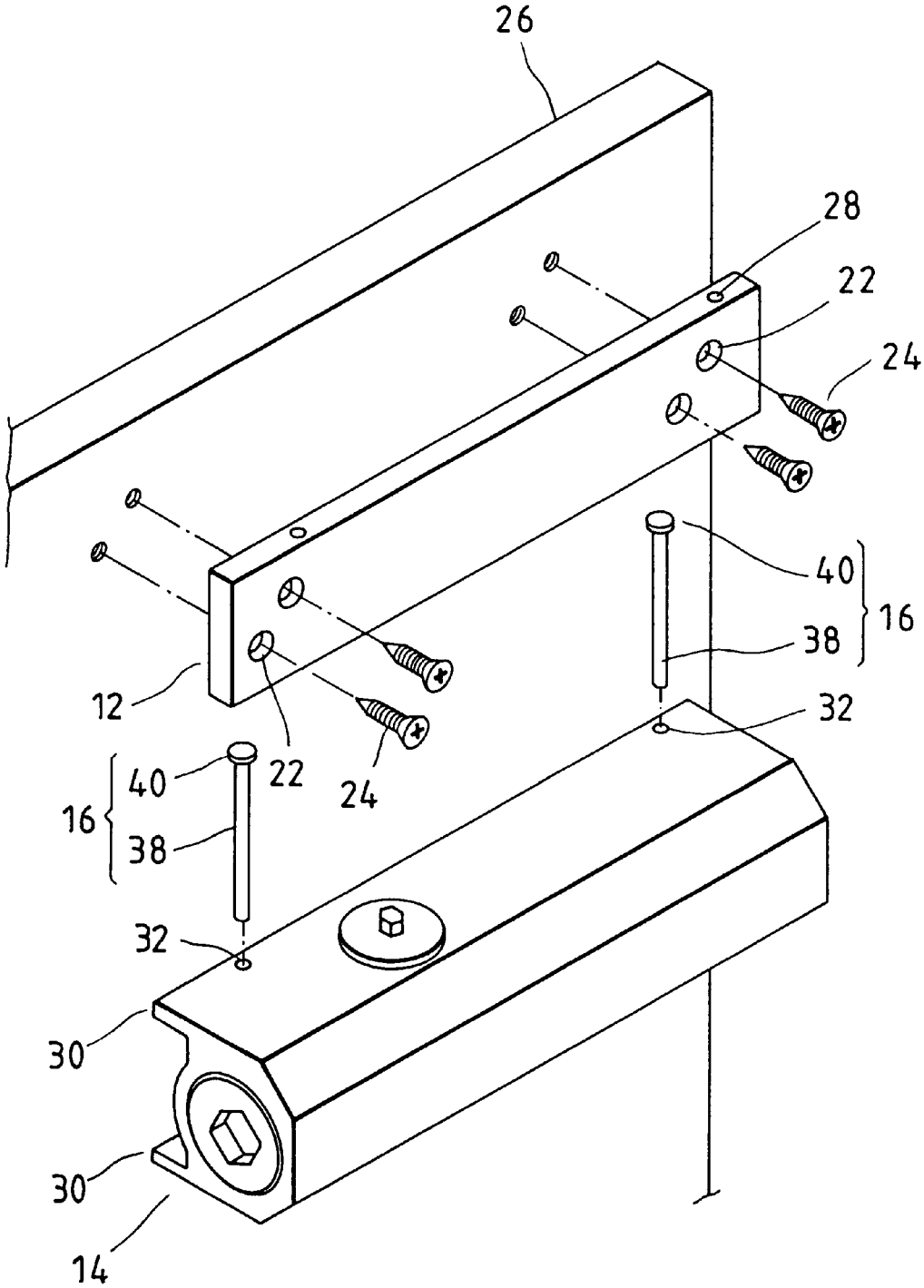
FIG. 1 shows an exploded view of a preferred embodiment of the present invention.
Figure 2:
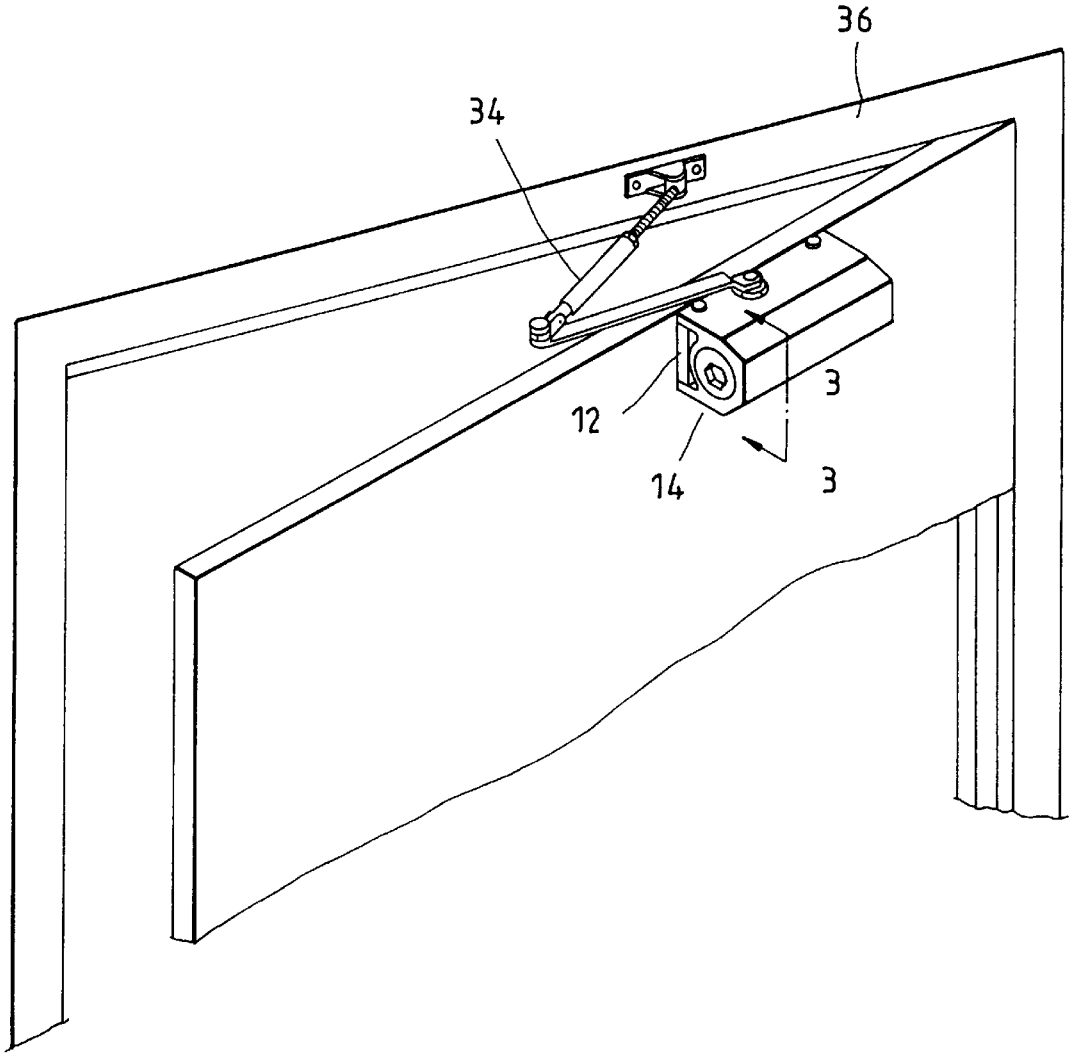
FIG. 2 shows a schematic view of the preferred embodiment of the present invention at work.
Figure 3:
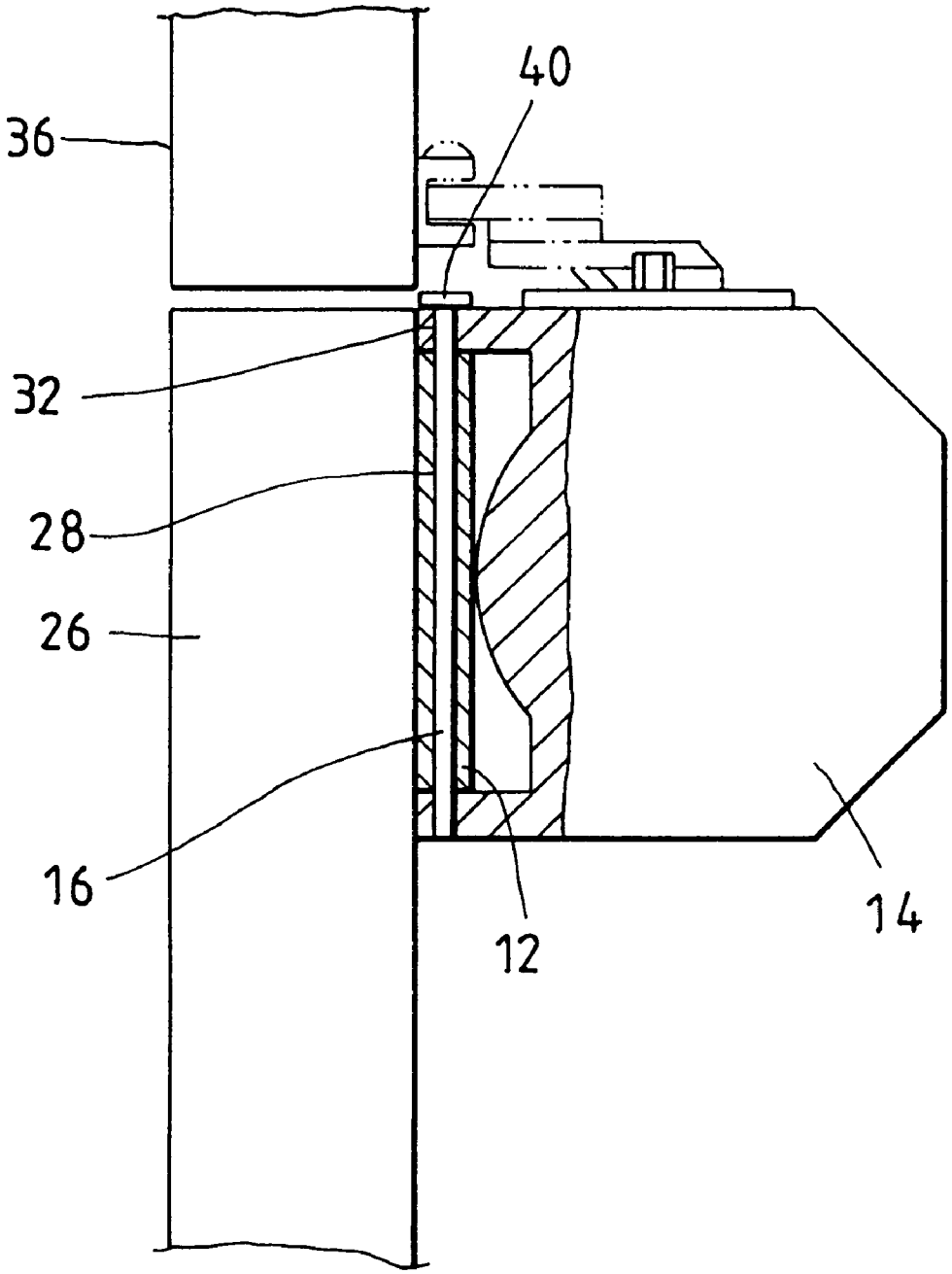
FIG. 3 shows a sectional view taken along the direction indicated by a line 3—3 as shown in FIG. 2.

As shown in FIGS. 1–3, an oil pressure door closer is provided with a locating structure of the present invention, which is composed of a locating plate 12, a main body 14, and two fastening pins 16.

The locating plate 12 is rectangular in shape and is provided with four screw holes 22. The locating plate 12 is fastened with the upper end of a door 26 by four screws 24 which are engaged with the four screw holes 22. The locating plate 12 is provided with two fastening holes 28 parallel to the surface of the door 26.

The main body 14 is fastened with one end of a crank arm 34 which is in turn fastened at other end thereof with a door frame 36, as shown in FIG. 2. The main body 14 is provided in one longitudinal side thereof with two longitudinal edges 30 parallel to each other and forming therebetween a longitudinal space in which the locating plate 12 is accommodated. The two longitudinal edges 30 are provided with two through holes 32 corresponding in location to the two fastening holes 28 of the locating plate 12. The locating plate 12 is held securely between the two longitudinal edges 30 of the main body 14 by the two fastening pins 16 which are received in the through holes 32 of the main body 14 and the fastening holes 28 of the locating plate 12.

The fastening pins 16 have a head 40 and a shank 38 which is equal in length to the sum of the width of the locating plate 12 and the thickness of the two longitudinal edges 30. The shank 38 is corresponding in diameter to the through holes 32 and the fastening holes 28. The head 40 is greater in diameter than the shank 38.

The shank 38 of the fastening pins 16 may be slightly smaller in length than the sum of the width of the locating plate 12 and the thickness of the two longitudinal edges 30.

It is therefore readily apparent that the main body 14 can be easily fastened with the locating plate 12 by two fastening pins 16 which are resistant to the tangential motion of the main body 14 relative to the locating plate 12 at the time when the door 26 is opened.

In light of the head 40 of the fastening pins 16 being located on the outer surface of the main body 14, the fastening pins 16 are located securely in the through holes 32 and fastening holes 28 in the event that the through holes 32 are different in hole diameter from the fastening holes 28, and that the main body 14 is thus caused to sway.

The embodiment of the present invention described above is to be deemed in all respects as being merely illustrative and not restrictive. Accordingly, the present invention may be embodied in other specific forms without deviating from the spirit thereof. The present invention is therefore to be limited only the scopes of the following appended claims.

What is claimed is:

1. A locating structure of an oil pressure door closer, said locating structure comprising:

a locating plate adapted to be fastened with a door and provided with a plurality of fastening holes parallel to surface of the door;

a main body of a door closer and provided in one longitudinal side thereof with two longitudinal edges parallel to each other and forming therebetween a longitudinal space for accommodating said locating plate, said two longitudinal edges provided with a plurality of through holes corresponding in location to said fastening holes of said locating plate; and a plurality of fastening pins received in said through holes and said fastening holes for fastening said main body with said locating plate.

2. The locating structure as defined in claim 1, wherein said fastening pins have a shank and a head greater in diameter than said shank.

3. The locating structure as defined in claim 2, wherein said shank is equal in length to the sum of a width of said locating plate and the thickness of said two longitudinal edges.

4. The locating structure as defined in claim 2, wherein said shank is smaller in length than the sum of a width of said locating plate and the thickness of said two longitudinal edges.

* * * * *